United States Patent [19]

Skogward

[11] 4,068,604

[45] Jan. 17, 1978

[54] SEWING MACHINE

[75] Inventor: Kenneth Oscar Emanuel Skogward, Jonkoping, Sweden

[73] Assignee: Husqvarna AB, Sweden

[21] Appl. No.: 691,098

[22] Filed: May 28, 1976

[30] Foreign Application Priority Data

May 28, 1975 Sweden ..... 7506074

[51] Int. Cl.[2] ..... D05B 3/02

[52] U.S. Cl. ..... 112/158 E; 112/158 D

[58] Field of Search ..... 112/158 D, 158 E, 158 A, 112/158 B, 158 R, 121.11; 74/568

[56] References Cited

U.S. PATENT DOCUMENTS

| | | | |
|---|---|---|---|
| 3,812,729 | 5/1974 | Ketterer | 112/158 D X |
| 3,847,100 | 11/1974 | Garron | 112/158 E |
| 3,929,081 | 12/1975 | Ketterer | 112/158 D |

*Primary Examiner*—Werner H. Schroeder
*Assistant Examiner*—Peter Nerbun
*Attorney, Agent, or Firm*—Holman & Stern

[57] ABSTRACT

The instant invention concerns a sewing machine having electromagnetic control elements for swinging out the needle-rod sideways and/or accomplishing the forward movements of the fabric slider, which control elements being activated by means of electrical signals vary the thickness of a packet of plates which in turn vary the displacement of the needle-rod sideways.

3 Claims, 8 Drawing Figures

SEWING MACHINE

BACKGROUND OF THE INVENTION

The producing of needle-rod movements and forward movements is made from the start of the sewing machine by means of mechanical drive-means, such as cams, rocker arms, cam disks and cam followers. Depending on the possibility provided by the state of the art to enable more and more complicated patterns for sewing, the mechanisms have grown in size and are therefore more complicated and expensive to manufacture. The further development of sewing machines into more overall useable machines must be based on finding alternatives to the mechanical control mechanisms which, during the entire life of the sewing machine, have been the sole auxiliary means for producing the movements in the needle-rod which will form the design.

It is desirable to provide a sewing machine which in the commonly known manner is provided with elements which form the stitches by means of a needle-rod mechanism and a shuttle mechanism. These mechanisms are preferably driven by the main shaft of the sewing machine and therefore have a simple, common design. The elements which form the designs, comprise the feeding mechanism, stitch-field and the stitch-width control mechanisms, and perform a complicated design of movements and forces, and are guided by means of a central control unit. Modern sewing machines which can be set for a multitude of varying standard seams, require in the prior art types of sewing machines a number of manipulations with various controls.

SUMMARY OF THE INVENTION

It is an object to provide a sewing machine with one control which will regulate the lateral movements of the needle-rod and feed mechanisms.

It is a further object of the present invention to provide an electronic control circuit to vary the lateral movements of the needle-rod and feed mechanism.

In accordance with the above and other objects, the present invention is a sewing machine having design-forming elements which are operated by means of a movement-converter, and the central control units comprising electronic control circuits, with an information carrier controlling the setting of elements in the movement converter, and based thereon, produces the setting of the lateral movements on the needle-rod or the feed mechanism.

BRIEF DESCRIPTION OF THE DRAWINGS

In order to further understand the invention reference may be had to the following illustrations of one embodiment of the present invention, wherein.

DETAILED DESCRIPTION OF A PREFERRED EMBODIMENT

Figure 1:
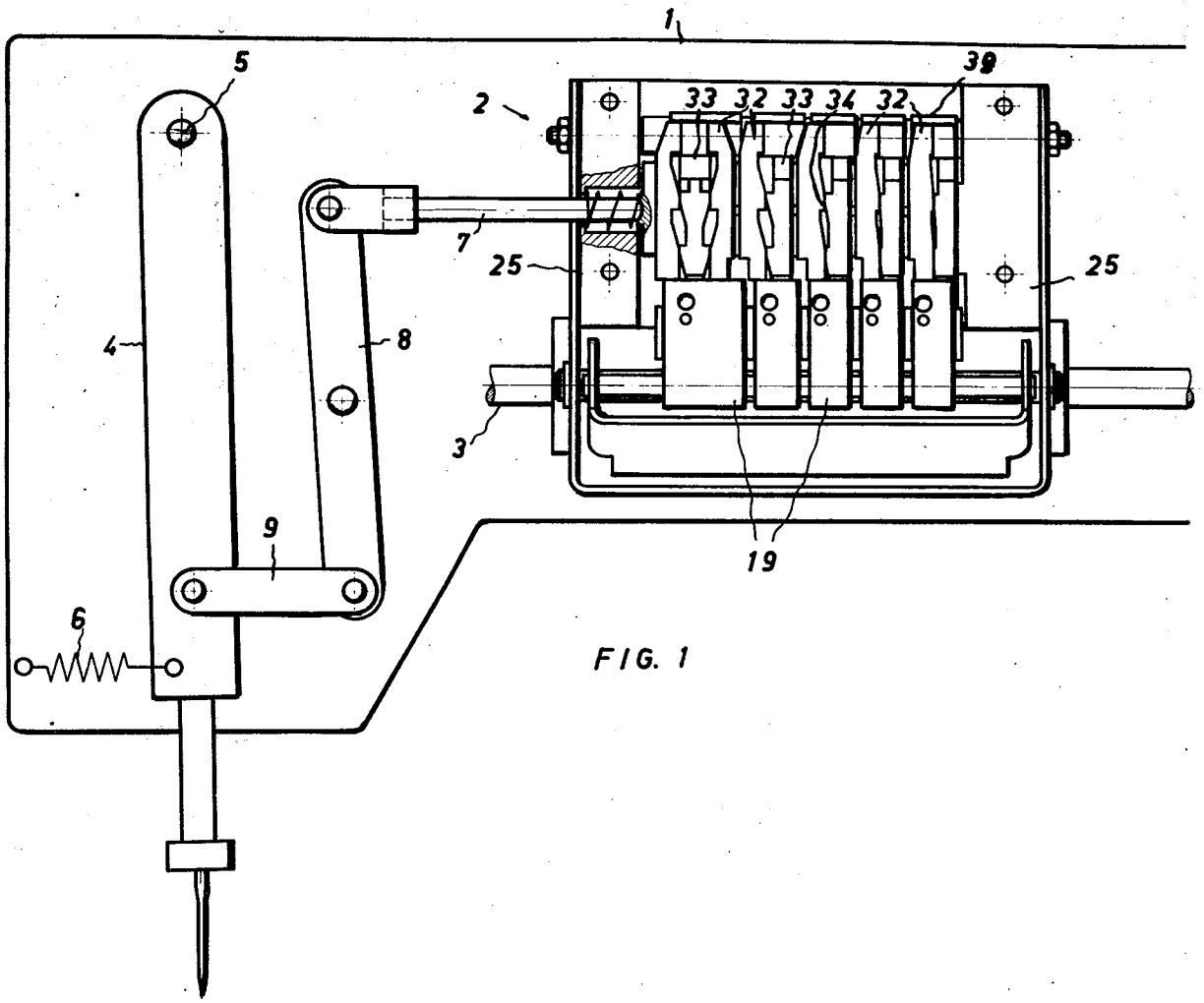
FIG. 1 is a cross-sectional view of the upper arm of a sewing machine according to the instant invention.

Referring now to the drawings wherein like reference numerals designate identical parts throughout the several views.

The major structure of the sewing machine comprises, as in the prior art, a frame, an upper and a lower arm, drive elements, and transmissions. In order to move the fabric forward, through the sewing point, there is mounted in the lower arm a conveyor mechanism (not shown) and for the lateral swinging of the sewing rod there is indicated a zig-zag mechanism at the terminal end of the upper arm 1. In FIG. 1, the control element for the zig-zag mechanism represents a movement converter 2 which is arranged in the upper arm 1. A central control unit (not shown), maybe arranged under the bottom plate of the sewing machine. The central control unit contains, among others, a program-selector, which is reachable from the outer side by means of a set of push-buttons, hand-wheels or the like on the frontal side of the machine. The control unit receives impulses from the transmitters which are mounted on an upper arm shaft 3 of the upper arm 1. The needle rod is positioned in a cross-shaft 4 with a swivel axis 5, which axis carries the needle rod mechanism. The needle rod mechanism is in the common manner driven by means of a crank on the shaft 3, as is well known. The cross shaft 4 is baised on one side by a spring element 6 which pulls the rod to its left starting position. From this starting position, the rod is guided in the zig-zag movement according to the varying design, by means of a push-rod 7 through positioning rod 8 and point 9. Push rod 7 is variably positioned according to the movement in movement converter 2.

In the lower arm there is located a shuttle-mechanism, which is associated with a fabric conveyor and a stitch-blade, as is the case in a conventional sewing machine. These portions are known in the prior art and do not require further explanation. One embodiment which deviates from the state of the art, is the arrangement of a movement convertor similar to the one indicated with numeral 2, in FIG. 1 which regulates the length of the stitches by controlling the feed of the machine. One embodiment having the above-described movement converters is shown in German Pat. Application No. P 2526,016.6-26 and is described therein. It is possible to improve the present invention having the movement converter 2 by addition of a further converter for the advancement of the fabric in the sewing machine.

Figure 2:
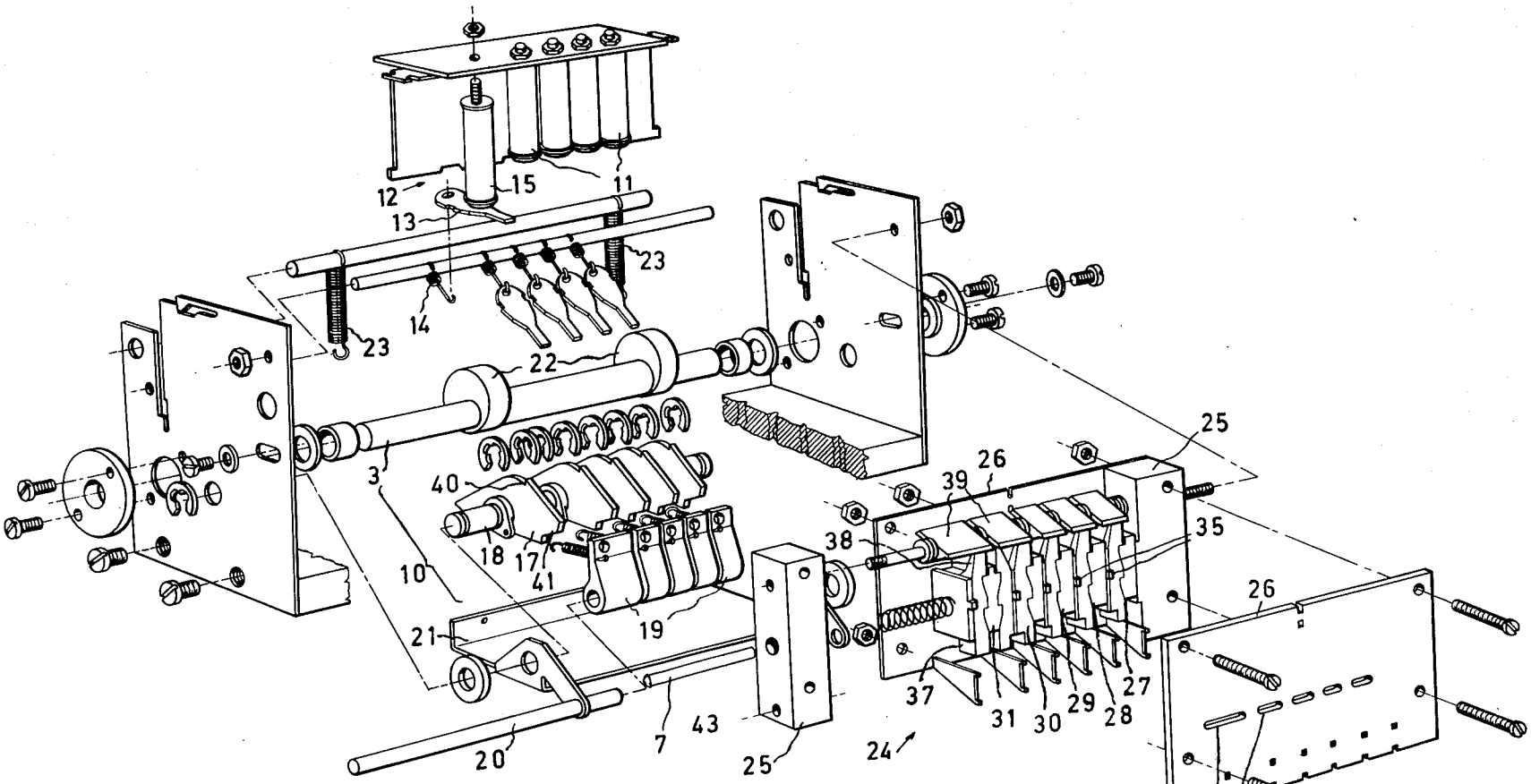
FIG. 2 is an exploded view of the movement converter of the present invention.
Figure 3C:
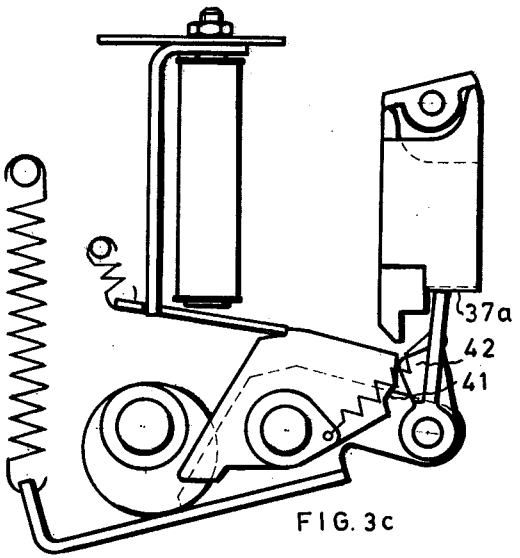
FIGS. 3*a*, 3*b*, and 3*c* are schematic illustrations of the control elements which engage the movement converter.
Figure 3B:
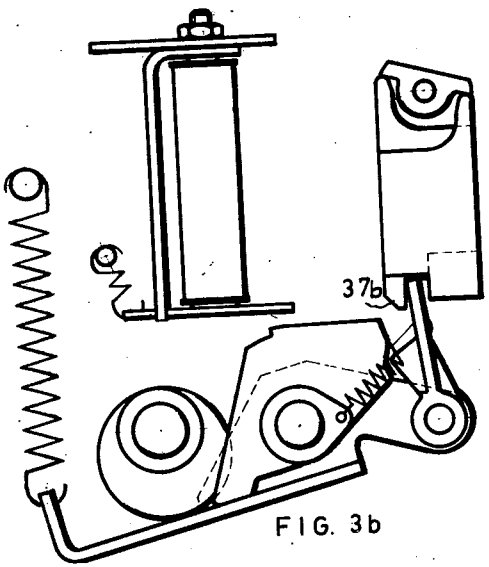
Figure 3A:
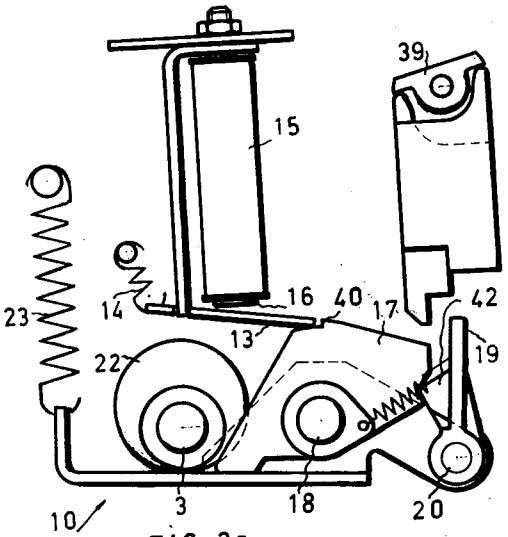

The above-mentioned movement converter 2 is described in more detail by reference to FIGS. 2 and 3. It is designed as in the illustrated embodiment for producing zig-zag movements and is driven by the upper arm shaft 3. The housing of the movement converter 2 comprises gables, bottom plate, and a cover plate, in which the various portions of the converter are retained in their position by means of shafts and screws. In converter 2, there are five consecutively arranged, electromagnetically controlled treadles 10 each with an associated electro-magnetic control element 11. A typical treadle 10 is shown coacting with the control element 11 in various operational positions in FIGS. 3*a*, 3*b*, and 3*c*. The control element 11 is shown as an electro-magnet 12 and an anchor 13. When in an inactive position, the anchor is positioned as shown in FIG. 3*a*, and in the activated position it is as shown in FIG. 3*b*. The electromagnet 12 is fastened in the cover plate and is provided with connecting wires to a central control unit, which transmits impulses to the magnet-coil. The anchor 13 is biased in the inactive position by means of a spring 14, and when activated by the passing of current in the electro-magnetic 12, it is pulled against the magnet core 16.

In general, each treadle 10 is engaged by- a control curve disk 17, positioned on a continuous shaft 18, and a lifting device 19, positioned in a shaft 20, which is carried by an oscillating plate 21, rotating mounted on the shaft 18. The plate is being oscillated by means of upper arm shaft 3 rotating a pair of cams 22, said shaft penetrating the gables and driving the converter. Springs 23 secure the plate in its position against the cam 22.

Above the lifting devices 19 there is arranged in the converter a curve plate packet 24 between a pair of lateral plates 26. This packet is divided into five curve plate sets 27–31, each one of them being associated with the lifting devices 19. Each curve plate set comprises two curve plates 32, 33 (the set furthest to the left has three) and the contact area between the plates is wave-shaped so that the thickness of each plate set is determined by the relative movement of one plate towards another. Between each curve plate set there exists a metal plate 35, provided with projections, which are positioned in grooves 36 in the lateral plates 26. It is the task of these metal plates to prevent the movement of one set of curve plates from being transmitted to an adjacent set of curve plates. This is necessary when selectively switching off each curve plate set. Each wave front in the contact area of the curve disk has a curvature 34 and the crest of this curvature varies from one set of curve plates to another. The transverse movements which are described by the sets of curve plates, when the plates in each set are displaced in relation to each other, the movement is thereby adjusted individually for each set; the length of the individual movements in the various sets of curve plates is determined by the expression $2^n$, where $n = 0, 1, 2, 3, 4 \ldots$ i.e., in that the length of the relative movements in the various sets of curve plates are 1:2:4:8:16. The sets of curve plates are placed in series to each other, so that, the individual movements are added and movements in various lengths between 0 and 31 in the converter 2 can be achieved.

In order to vary the plates of a set, a slide-movement is required between the plates. All plates are therefore provided with handles 37 and 28 at the upper and lower end portions. The lower handle 37 cooperates with its respective lifting device 19, and the upper handle 38 cooperates with a rocker 39 positioned above each of the sets of curve plates. The sliding movement is produced by the lifting device 19, which is able to activate either one or the other of said plates in a respective set of curve plates. In FIG. 3*b*, the lifting device is raising one of the curve plates (33) and in FIG. 3*c* it is taking a position for activating the other (32) of the curve plates. The lifting of one curve plate means a respective lowering of the other, since the rocker 39 varies from one position as shown in FIG. 3*b*, to the other end position, according to FIG. 3*c*.

This produces the advantageous result that the relative movement between the curve plates is twice as large as the movement of the lifting device and therefore, the cam 22 will not have to perform such large movement. Additionally, the switch-over between different movements is always taking place in the same portion of the operating cycle of the machine.

The position of the lifting device controls the function of the curve plate packet 24. The position of each lifting device 10 is determined by respective control elements 10 and 11 such that the anchor 13 is able to engage detent 40 of the control curve plate 17. When plate 21 begins to pivot around shaft 18, anchor 13 can engage detent 40, whereby the control curve plate 17 is being stopped from further rotation. The lifting device 19, coupled to the plate 21 by means of a shaft 20, together with its cam follower 42, is then climbing onto a curve 41, with the result that the lifting device 19 alters its position to the right; this position at the right is obtained immediately before the lifting device meets the handle 37*a* of the curve plate 32 (FIG. 3*c*). The lifting device will continue to move somewhat and this will result in that the curve plate 32 will move upwards. Simultaneously, the rocker 39 is being activated by means of handle 38 and the rocker 39 itself will activate the handle 38 of the curve plate 33 so that it is moved downward. A relative movement between the curve plates 32 and 33 is thus produced, which is twice the size as the movement of the lifting device 19.

When the anchor 13 is pulled close, (as in FIG. 3*b*) the control curve plate 17 will follow the movement of the tilting of the plate 21. This means that the cam follower 42 of the lifting device will remain positioned on the lower section, and therefore no switching-over of the lifting device will take place. The lifting device 19 will then engage the handle 37*b* of the curve plate 33 (FIG. 3*b*). When the lifting device 19 raises curve plate 32, the curves of each of the plates, will slide towards each other and come to a stop "crest to crest". The plates then have a maximum thickness and are separated with a distance which is equal to the height of the curvature in the curve plates (see FIG. 1). If during the next rotation of the shaft 3, the lifting device raises plate 32 to the position as shown in FIG. 3*b*, the curves slide apart and the set of curve plates will have a minimum thickness.

In the curve plate packet 24, the sets of the curve plates are axially displaceable in a direction parallel to shaft 18 and are biased against the side portion 25 by a spring means which is stressed against the other side portion. The push rod 7 is guided through the spring and a hole 43 in the side portion and transmits the cumulative thickness of the sets of the curve plates to the lever rod 8.

The movement converter can be made to rapidly perform adjustments to the needle rod cross-shaft position. It is not uncommon that a sewing machine performs more than 1000 machine-rotations per minute, which means a switch-over of the sets of curve plates each 50th of a millisecond. The interval of the switch-over per se is substantially shorter than 50 ms since the switch-over of the needle-rod cross-bar must be performed during the portion of the machine cycle when the needle is located above the stitch-plate. Time-wise, the switch-over during this interval is controlled by means of a position sensor which registers the angular position of the upper sleeve shaft during each machine cycle, and connects the setting impulses from the central control unit to the electro-magnets 12.

Figure 4A:
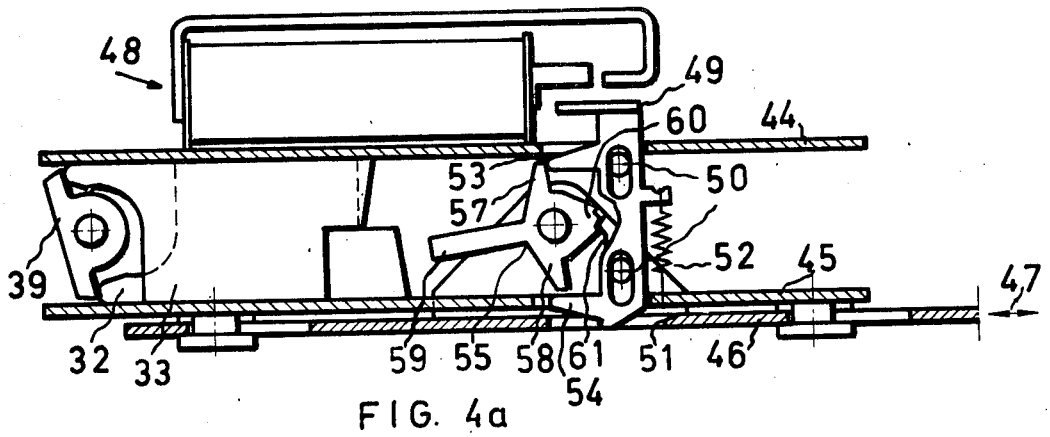
FIGS. 4*a*, 4*b* and 4*c* are schematic illustrations of variants of control elements entering the movement converter.
Figure 4B:
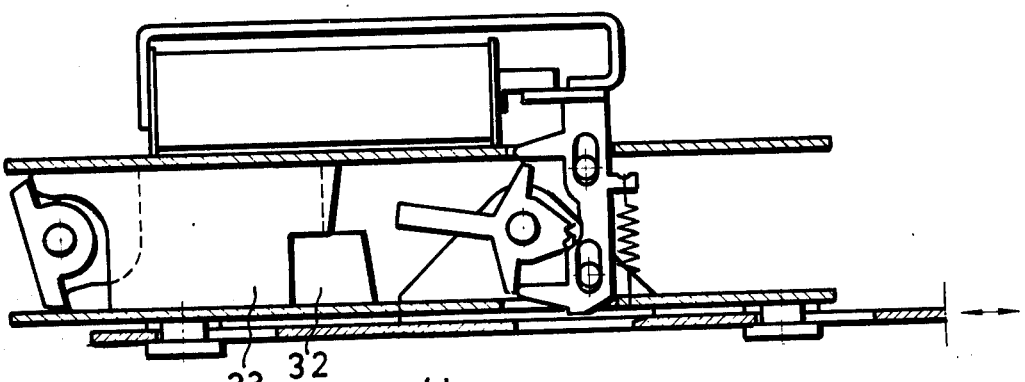
Figure 4C:
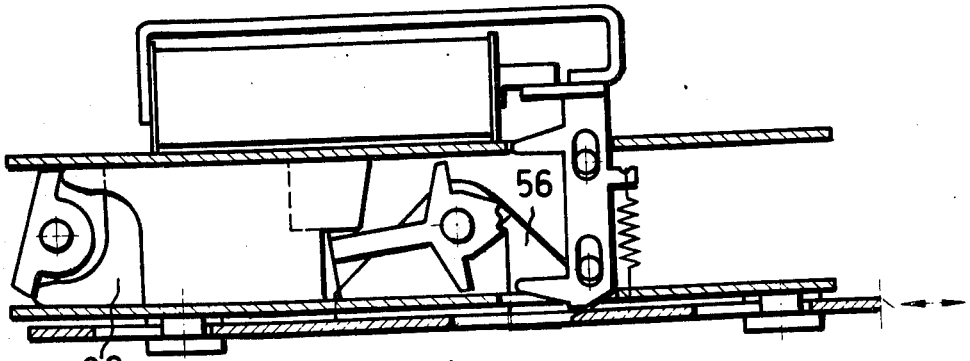

The above embodiment of the control elements and the treadles can be modified and simplified, as shown more clearly in FIGS. 4*a*, 4*b*, and 4*c*. According to these figures, the converter is mounted between a pair of plates 44 and 45, whereof one carries a slider 46 at its outer side, which slider is moved forward and backward in the direction of arrow 47 by means of a cam mechanism or the like, driven be means of a shaft in the machine. The other plate carries an electro magnet 48 with a yoke and an anchor 49, which is positioned on small rods 50 by means of elongated holes in the same, which enables the on- and off-switching movement of the anchor. The outer end of anchor 49 extends through an opening in the plate 44 and cooperates with a boss member 51 of the slide 46. When the boss member passes below the anchor, it is being switched over as shown in FIG. 4*c*. It is at this point that the setting of the curved plate will be determined. When the boss member 51 of the slider 46 has lifted the anchor, only a holding current on the electro-magnet is required to maintain the anchor in the upper position. This has the advantage of reducing the electromagnet requirements. A return spring means 52 biases the anchor in the opposite direction such that without the holding curent in the electromagnet, the anchor will return to its lowermost position upon the withdrawal of boss member 51.

The anchor is provided with a couple of small tabs 53 and 54, which cooperate with a switch-over member 55. The switch-over member is rotatably mounted on a holder 56, which is fixedly mounted on the slide 46. The switch-over member 55 is provided with two arms 57 and 58, a handle means 59 and a toothed section 60, and is utilized for for resetting the curve plates 32 and 33 in a group of curve plates similar to that shown in FIG. 1. The sleeve 57 and 58 cooperate with the small tabs 53, or 54 as shown in FIG. 4*a* and 4*b*. In the position shown in FIG. 4*a*, the handle means 59 is directed towards the lowermost-positioned curve plate 32 and in the position shown in FIG. 4*b* the handle is directed towards the uppermost-located curve plate 33. The slider moves a leftward movement (as in FIG. 4*c*) and the handle thus engages one or the other curve plate (the lower one, in FIG. 4*c*). The curve plates are displaced by means of the activation of the switch-over members 55 in the same manner as described in connection with the function of the lifting device 19. In the embodiment shown, there exists also a positioned plate 39, which transmits movements from one plate to the other plate as described above.

The position of the switch-over member 55 is dependent on the position of the anchor during the backwards movement of the slider. The anchor is retained either in the full-up position by the electro-magnet 48 (according to FIG. 4*b*) or in the switched-off position by the return-spring 52 (according to FIG. 4*a*). During the prededing movement of the plate, the switch-over member 55 is retained in the position set by the anchor by toothed section 60 mating with a projection on the holder means 56.

Thus, it is here, as well as in the above-described embodiment, that the current-impulses to the electromagnet determines the position of the anchor, which determines the thickness of the actual set of curve plates in the packet of the curve plates 24 and thus te magnitude of transverse needle movement.

Variations of the above described embodiment may be realized by those skilled in the art within the scope of the instant invention. For example, simplifications may be made in the construction, whereby the number of parts can be reduced. The coverage of this patent is therefore limited only by the appended claims.

I claim:

1. In a sewing machine for stitching material, said sewing machine comprising motor means for powering said sewing machine;

needle means, responsive to said motor means, for forming stitches;

zig-zag means for controllably displacing said needle means in a direction angularly displaced from the path of material through the machine to form a zig-zag stitch pattern, said improvement of said zig-zag means comprising:

control means, responsive to manual setting of a desired stitch pattern, for providing a control signal indicative of a desired displacement of said needle means from said path of material through said machine;

converter means, responsive to said control means, for producing a variable thickness, said thickness varying according to said desired displacement, said converter means comprising a plurality of packet means for providing a variable thickness, said thickness variable between a thick and thin position;

electromagnetic activating means for operating said packet means between said thick and thin positions;

linkage means for sensing said variable thickness of said converter means and displacing said needle means in response thereto;

said packet means comprising at least two plates, each of said plates having at least one raised portion and one flat portion, said plates, acting in cooperation with said raised and flat portions, providing a variable thickness of said packet means when said plates are moved relative to each other, said packet means further comprising rocker means, responsive to both plates of said packet means, for moving one of said plates in response to movement of the other of said plates in the opposite direction, said movement varying the thickness of said packet means between a thick and thin position.

2. The apparatus of claim 1 wherein said electro-magnetic actuating means further comprises lift means for moving one of said plates in said packet means, said lift means operable between either of said plates in response to energization of said electro-magnetic actuating means.

3. The apparatus of claim 2, wherein said plurality of packets are arranged in series having a total change in thickness wherein said change in thickness is proportional to the sum of the changes in thickness of the individual packet means, and the maximum change in thickness of each packet means varies according to the formula; change in thickness $= 2^n$ where $n$ is an integar representing the position of the packet means in the series.

* * * * *